United States Patent [19]

Palus et al.

[11] Patent Number: 4,894,014

[45] Date of Patent: Jan. 16, 1990

[54] APPARATUS FOR PREVENTING THE TWISTING OF ELECTRICAL CABLES

[76] Inventors: Joseph Palus, 123 Gracey St., Edison, N.J. 08817; Joseph A. Kapler, 197 Fresh Ponds Rd., South Brunswick, N.J. 08831

[21] Appl. No.: 237,449

[22] Filed: Aug. 29, 1988

[51] Int. Cl.[4] ..... H01R 35/00

[52] U.S. Cl. ..... 439/17; 439/20

[58] Field of Search ..... 439/13, 17–21, 439/23, 24, 28

[56] References Cited

U.S. PATENT DOCUMENTS

| | | | |
|---|---|---|---|
| 1,955,652 | 4/1934 | Pearson | 439/17 |
| 1,973,234 | 9/1934 | Tsavaris | 439/17 |
| 2,474,070 | 6/1949 | Sokolik | 439/20 |
| 2,502,252 | 3/1950 | Faile | 439/20 |
| 3,123,421 | 3/1964 | Phillips | 439/20 |
| 3,195,094 | 7/1965 | Mohr | 439/17 |
| 4,592,605 | 6/1986 | Kapler | 439/17 |
| 4,708,658 | 11/1987 | Kapler et al. | 439/25 |

FOREIGN PATENT DOCUMENTS

| | | |
|---|---|---|
| 531432 | 8/1955 | Italy . |
| 543314 | 5/1956 | Italy . |
| 562438 | 5/1957 | Italy . |
| 700847 | 1/1966 | Italy . |
| 272686 | 3/1951 | Switzerland . |

*Primary Examiner*—Gary F. Paumen

*Attorney, Agent, or Firm*—Arthur L. Plevy

[57] ABSTRACT

An apparatus for preventing the twisting of electrical cables is constructed with bearing assemblies for conducting electrical current from a fixed cable end to a rotatable cable end. The apparatus employs a housing and fixed and rotatable cable clamping devices attached thereto. The housing and clamping devices cooperate to transmit tensile loads on the cable through the rigid apparatus housing thereby preventing wear and damage to the moving electrical contacts. An idler bearing is employed to minimize torsional strains on the cable conductors by permitting cable to rapidly change position within the apparatus.

12 Claims, 2 Drawing Sheets

APPARATUS FOR PREVENTING THE TWISTING OF ELECTRICAL CABLES

BACKGROUND OF THE INVENTION

This invention relates generally to electrical wiring devices and more particularly to an apparatus which is employed in conjunction with a bearing assembly utilized for preventing the twisting or coiling of an electrical cord.

Twisted wires have often plagued operators of hand-held appliances and tools. For example, a device is plugged into a conventional outlet and, during operation, the power cord becomes twisted. As a result, the plug might be pulled out of the socket, or, if the cord is old and brittle, it might break. Thus, the problems associated with twisted power cords are apparent.

The prior art is replete with many patents which relate to the problem of avoiding the twisting or coiling of various wires. Many of such patents utilize a conductive bearing assembly to allow rotation of one wire with respect to the other while other patents utilize a conductive bearing assembly to prevent the twisting of an input wire with respect to an output wire. Essentially, reference is made to U.S. Pat. No. 4,592,605 entitled "Apparatus for Preventing the Twisting of an Electrical Cord or Cable" issued on Jun. 3, 1986 to Albert W. Kapler of Edison, N.J. See also U.S. Pat. No. 4,708,658 entitled "Apparatus for Eliminating Noise in Conductive Bearing Electrical Connectors", issued on Nov. 24, 1987 to Albert W. Kapler and Joseph A. Kapler, an inventor herein. The above-noted patents were concerned with the twisting or coiling of telephone wires. These inventions could also be adapted to prevent the twisting of other types of wires, such as electrical line cords which are conventionally employed in conjunction with a typical power line.

Thus, a twisted cord causes the plug to be pulled out of the socket or otherwise rotated which will cause the cord to break. It is therefore desirable to provide a device which will rotatably connect an electrical cord to a convenience outlet or rotatably connect two parts of an electrical cord, to permit manipulation of the device to which the cord is connected without twisting of the cord. One can, of course, understand that in order to provide such a device suitable for domestic use, the device must be simple, reliable and fabricated at low cost.

The prior art is replete with many devices which attempt to solve the problem. For examples of typical prior art, reference is made to U.S. Pat. No. 913,831 patented Mar. 2, 1909 and entitled "Swivel for Electrical Appliances". Essentially, the patent shows a rotatable or swivel assembly which is used in conjunction with an electrical appliance, such as a curling iron. The device employs ball bearings in order to provide rotation of an input wire with respect to an output wire to thereby prevent twisting. Similarly attention is directed to U.S. Pat. No. 1,649,276 issued on Nov. 15, 1927 to A. G. Adam entitled "Electrical Swivel Connection". This patent shows a mechanism for relieving electrical conductors within the cable from tensile strain. In that patent the strain relieving mechanism disclosed includes a boss 19 which is provided on the electrical cable such that it engages a cap nut 11. In any event, that patent also shows the use of conductive bearings to prevent twisting of the electrical cord. Reference is also made to U.S. Pat. No. 1,837,890, U.S. Pat. No. 2,181,145, U.S. Pat. No. 2,328,212, U.S. Pat. No. 2,502,252, U.S. Pat. No. 3,123,421 and U.S. Pat. No. 3,581,267. Reference is also made to foreign patents as follows: Swiss Pat. No. 272,686, Italian Pat. No. 562,438, Italian Pat. No. 700,847, Italian Pat. No. 543,314 and Italian Pat. No. 531,432. Essentially, all of the above noted patents relate to various devices including ball bearings for preventing the twisting of one electrical cord with respect to another in order to solve the above-described problems.

While the aforementioned references teach the use of conductive bearing assemblies to eliminate torsional stress, they do not address problems as for example the tensile strain produced on such connectors or cables, which frequently occurs at the same time they are subjected to rotation. The tensile load pulls the wires apart at their electrical connections, thereby disconnecting the appliance.

Furthermore, a problem arises when the mechanism can follow the motions of the cable in a rapid manner. The prior art devices, while attempting to solve the general problem of free rotation, exhibit these difficulties in that the mechanisms employed created extensive tensile strains on the cables while being relatively slow so as not being able to follow cable motion.

Other considerations include a device which is capable of handling commercially practicable amounts of current as supplied through a conventional wall socket to a hand tool. The device should be extremely simple and economical to manufacture and use.

Therefore, it is an object of the present invention to provide an electrical connector which reduces a torsional load on two connected cables and removes the tensile load at the connection thereof.

Another object of the present invention is to provide a means for transmitting tensile loads from the electrical connections of the cables to the apparatus. Still, another object is to provide a low friction device which allows one cable end to follow the motion of the other end freely and rapidly.

SUMMARY OF THE INVENTION

In accordance with one embodiment of the present invention, there is disclosed an anti-twisting device for electrical cable constructed with ball bearings and a cable clamping arrangement which is simple, uses readily available stock components and is reliable. The clamping arrangement disclosed makes use of an idler bearing and bearing retainer sleeve to enable free rotational movement of the cable end and to ensure proper alignment.

These and other objectives and advantages of the invention will become apparent from the following description when taken in conjunction with the accompanying drawings depicting the invention.

DETAILED DESCRIPTION OF THE FIGURES

Figure 5:
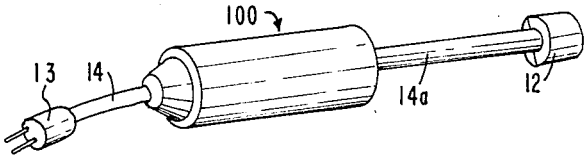
FIG. 5 is a perspective view of the apparatus.
Figure 6:
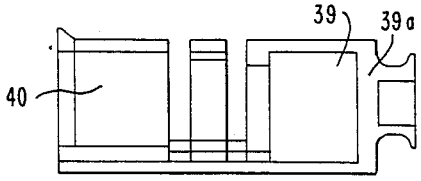
FIG. 6 is a side view of the housing section.

Referring to FIG. 5, there is shown an antitwist device 100 electrically connecting a first cable 14 to a second cable 14*a*. The first cable 14 is rigidly attached to the anti-twist device 100, and the second cable 14*a* is attached thereto for axial rotation therein. Thus when either wire 14 or 14*a* is coiled, the second cable 14*a* rotates about the axis of the anti-twist device 100, thereby preventing the cables 14 and 14*a* from twisting.

At the ends of the respective cables 14*a* and 14 are a female connector 12 and a male connector 13. The male connector 13 can be inserted into a wall socket (not shown) or a receptacle similar to the female connector 12. Thus, the anti-twist device 100 can be used in conjunction with such an item as a household appliance cord.

Figure 1:
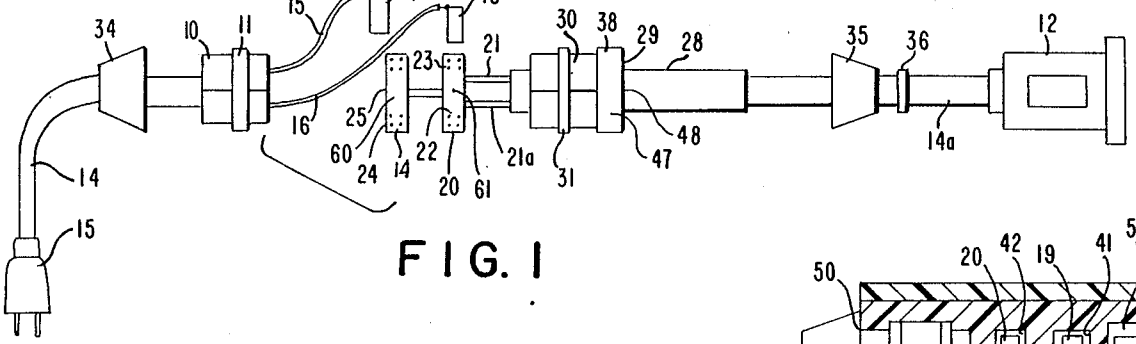
FIG. 1 is an exploded view showing the arrangement of internal components according to this invention.

Referring now to FIG. 1, one can discern that the female connector 12 and the male connector 13 can be interchanged with respect to the anti-twisting device 100. As seen, the male connector 13 is associated with a two-wire cable section 14 which cable terminates in a first wire 15 and a second wire 16. From examination of FIG. 1 it is seen that the female connector 12 is associated with a two wire cable section 14*a* which terminates in a third wire 21 and a fourth wire 21*a*. In practice, the number of wires may be varied over the range of commercial interest. The wires 15 and 16 of cable section 14 are associated respectively with first and second C-shaped clamp devices 17 and 18. The clamp devices 17 and 18 are inserted over the outer race 24 of a ball bearing assembly, such as 19, for clamp device 17 and the outer race 22 of ball bearing assembly 20 for clamp device 18.

Figure 2:
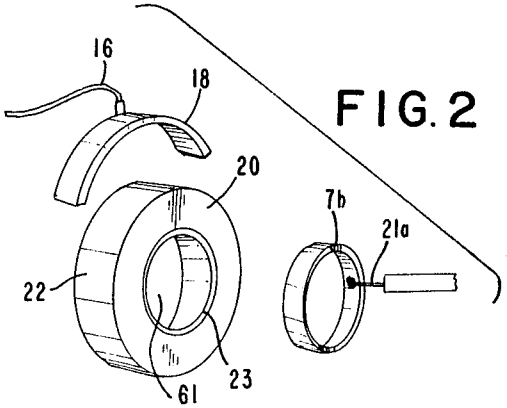
FIG. 2 is a perspective view of the bearing assembly.

Referring now to FIG. 2, there is shown a typical ball bearing assembly 20, having an inner race 23 and outer 22 race and a central aperture 61. Likewise, said ball bearing assembly 19 is comprised of an outer race 24, an inner race 25 and a central aperture. As shown in FIG. 2, the wire 21*a* of cable section 14*a* is permanently secured to the inner race 23 of ball bearing assembly 20. In the preferred embodiment, the wire 21*a* is secured to the inner race 23 by soldering the wire 21*a* to an inner sleeve 70. The inner sleeve 70 is press fit into the central aperture 61 of inner race 23 of ball bearing assembly 20. The inner sleeve is of a shape to form a press fit within the aperture 61 of the inner race 23. The inner sleeve 70 is electrically conductive and may be an annular or "C" shaped member which is so selected that when it is placed in aperture 61 it makes electrical contact with the inner race 23 where it is held in frictional engagement. The outer race 22 accommodates an electrically conductive C-shaped clamp 18 which is soldered or otherwise secured to wire 16. In this manner the C-shaped clamp 18 is inserted over the outer race 22 of the ball bearing assembly 20 and makes intimate contact therewith. The C-shaped clamp 17 is attached to wire 15 of the cable section 14 and is inserted over the outer race of bearing assembly 19, with wire 21 of cable section 14*a* connected to the inner race 25 of bearing assembly 19 in the same manner as set forth above for securing wire 21*a* to inner race 23 of bearing assembly 20.

In a similar manner, additional insulated wires may be directed through and affixed electrically and mechanically to the inner races of the respective bearing assemblies. Likewise the outer races of additional bearing assemblies may be connected by the afore-described C-shaped clamps to their respective wires.

As shown in FIG. 1, the cable section 14 is secured by a first plastic clamping device module 10 which is secured by an annular ring 11. Likewise cable section 14*a* is clamped by a second plastic clamping device module 30 with annular ring 31. The plastic clamping device modules 30 and 10 are standard, commercially available appliance cord clamps typically used to secure electrical cords at the point where the cord enters the housing of an appliance or motor. The aforesaid plastic clamping device modules 10 and 30 are comprised of segments or parts which parts are placed around the cable section and held securely in compression on the cable section by annular rings such as 11 and 31. The clamping devices 10 and 30 cooperate to prevent the cable section from being pulled out of a cylindrical housing 32L and 32R. It is an object of the invention to simply and effectively eliminate tensile strain on rotating parts such as the first and second bearing assemblies 19 and 20, the associated wires 21, 21*a*, 15, 16 and the first and second C-shaped clamps 17 and 18. One can ascertain by reference to FIG. 3 that both tensile and compression loads on the cable sections are taken up by the end portions of compartments 39 and 40 in the housing 32L and 32R and by the cable clamping device modules 10 and 30.

As previously mentioned, cable 14*a* rotates within the anti-twist device 100. This function is implemented by a bearing retainer 28, an idler bearing 29, and a plastic sleeve 38. The bearing retainer 28 is a metal sleeve having a flared end. The operation of the idler bearing 29 will be described later. Finally, FIG. 1 shows first and second grommets 34 and 35 whose functions will also be described later. The grommets 34 and 35 are made of an elastomeric material.

Figure 3:
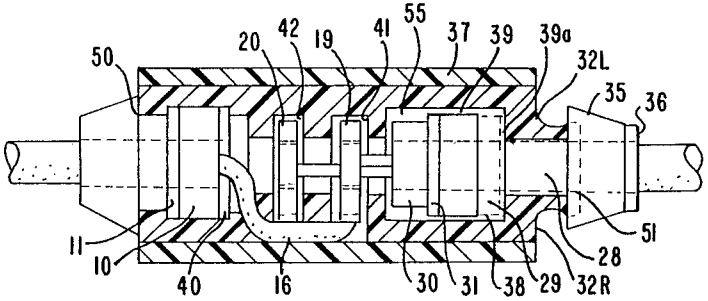
FIG. 3 is a sectional view of the apparatus according to this invention.
Figure 4:
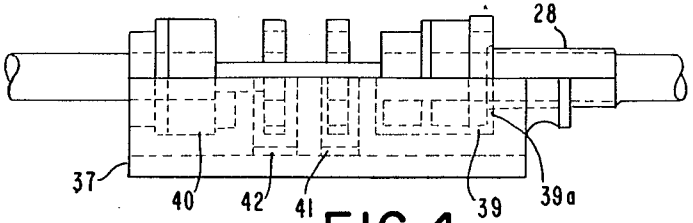
FIG. 4 is a top view of the housing with the cable and bearings.
Figure 7:
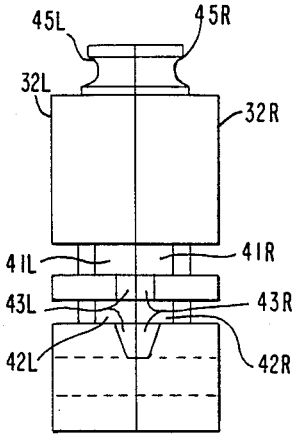
FIG. 7 is a top view of the housing showing wire accommodating recesses.
Figure 8:
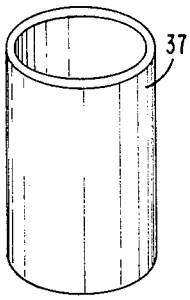
FIG. 8 is a perspective view of the housing sleeve.
Figure 9:
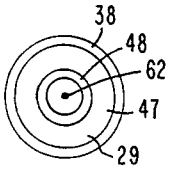
FIG. 9 is an end view of the bearing assembly with the housing sleeve.
Figure 10:
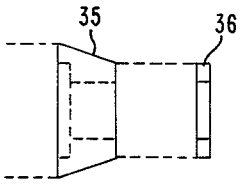
FIG. 10 is a side elevational view of the rotating cable and dust grommet.
Figure 11:
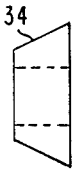
FIG. 11 is a side elevational view of the fixed cable end dust grommet.

Referring to FIGS. 3, 4 and 7, the cylindrical housing consists of two symmetrical sections 32L and 32R which are mirror images of each other and which contain an input port 50, and an output port 51 and an internal hollow 55. When the device is assembled the symmetrical housing sections 32L and 32R are locked together by a sliding plastic sleeve 37 which is depicted in FIGS. 3 and 8. The housing 32L and 32R is made of plastic or any suitable insulating material for insulating the ball bearing assemblies 19 and 20 from each other, thereby preventing a short circuit. The sleeve 37 can also be made of plastic. Further, the plastic used for the housing 32L and 32R and sleeve 37 can be transparent. The inner cylindrical surfaces of the housing sections 32L and 32R contain a plurality of precisely located congruent recesses. When the sections are fitted together the recesses form a series of compartments having specific functions and are identified as follows: rotating plastic clamping device module and idler bearing retaining compartment 39, fixed plastic clamping device module retaining compartment 40, first and second bearing assembly locating compartments 41L, 41R, 42L and 42R and wire locating compartment 43L and 43R. The structure of rotating clamping device module 30 and idler bearing compartment 39 is further refined to contain a chamfer at the neck 45L and 45R end, the function of which is to retain the flared end of the bearing retainer 28. At the fixed cable section end of the housing 32L and 32R is located the first dust sealing grommet 34 through which is directed the first two wire cable section 14 as shown in FIGS. 1 and 11. The dust seal grommet 34 is tightly fit on the cable section 14 and is dimensioned so that the surface abutting the housing 32L and 32R completely covers the opening and effectively prevents the penetration of dust, dirt and debris into the anti-twist device 100. Likewise, at the end of the housing 32L and 32R and through which the bearing retainer 28 and second two wire cable section **14*a* are directed is the second elastomeric grommet 35. As can be seen in FIG. 10, the bore of said grommet 35 is chamfered at the large end to produce a mating and sealing surface with neck 45L and 45R of the housing 32L and 32R. Due to the friction fit on the housing and the bearing retaining 28, the grommet 35 seals the aperture therewith and prevents the rotation of the idler bearing retainer 28 thereby further increasing the effectiveness of the idler bearing assembly 29 and plastic sleeve 38 in reducing torsional strains on the cable section and said wires. A dust seal is achieved over the aperture between the first two wire cable section 14*a* and the nonflared external end of the bearing retaining 28 through the use of an elastomeric washer 36 as shown in FIG. 3**.

It is apparent that the structure shown in FIG. 1 is positioned within the housing 32L and 32R. It is also apparent that the male connector 13, associated first two wire cable section 14, first plastic clamping device module 10 with annular ring 11, first and second wires 15 and 16, first and second C-shaped clamps 17 and 18 and first and second bearing assembly outer races 24 and 22 are immovable with respect to the housing 32L, 32R.

Referring to FIGS. 3, 4 and 5, a description of the means for achieving axial rotation of the anti-twisting device 100 will now be set forth. The third and fourth wires 21, **21*a* being directed through the central apertures 60 and 61 of and secured to the first and second inner bearing races 25 and 23 respectively are free to rotate with respect to the outer races. The two wires 21 and 21*a* of the second cable 14*a* has attached thereto the plastic clamping device module 30 with annular ring 31. Abutting against the plastic clamping device module 30 with annular ring 31 is the idler bearing assembly 29 consisting of an outer race 47 and an inner race 48 having an aperture therethrough. The idler bearing assembly 29 is contained in the plastic sleeve 38. The inner race 48 of the idler bearing rests against the flared end of the bearing retainer 28 which also functions as cable strain relief. As can be seen in FIG. 3, the flared end of the bearing retainer 28 is located within the housing 32L and 32R with the wide end of the flare opposite the plastic clamping device module 30, and the tapered end of the flare abutting against the second end of the housing 32L and 32R. The non-flared end of the bearing retainer 28 extends through the neck 45L and 45R and outside the housing 32L and 32R. The first two wire cable section 14*a* is directed through the bearing retainer 28, the idler bearing assembly 29 and as previously described, the clamping device module 30**.

The function achieved by means of the idler bearing 29, plastic sleeve 38, bearing retainer 28, all of which are retained in the compartment 39 of the housing 32L and 32R, is the rapid and unrestricted reaction to torsional loads whereby the second cable **14*a* and the housing 32L and 32R rapidly assume new positions so that the cable wires are subjected to minimal load. By this means an improvement over the problems of wire strain and metal fatigue endemic to the prior art is attained. It can be seen that the second cable 14*a*, via the plastic clamping device module 30 and the wires 15, 16, 21 and 21*a* have unrestricted rotation with respect to the housing 32L and 32R and its fixed cable end. What is also achieved by this arrangement of parts is that tensile loads on the cable sections are carried by the aforesaid first and second cable sections 14 and 14*a* through the plastic module clamping devices 10 and 30 with crimping rings 11 and 31 and the housing 32L, 32R** thereby eliminating the placement of undue forces on the various elements which comprise the anti-twisting device.

A brief description of the operation of the anti-twisting device will now be given. Electrical current is carried through the wires 15 and 16 to the C-shaped clamp devices 17 and 18 which in turn transmit the current to the outer races of bearing assemblies 19 and 20 which are electrically isolated from each other to prevent short circuits. The current is transferred through the ball bearings to the inner races 25 and 23 and then through inner sleeves 71 and 70 associated with inner races 25 and 23 to the associated wires 21, **21*a* which form part of second cable 14*a*. The anti-twist device housing 32L, 32R fastened together by sleeve 37, rigidly retains the plastic cable clamping device module 10 and the outer bearing races 22 and 24. The inner bearing races 23 and 25 rotate freely relative to the housing, as does the cable 14*a*, by virtue of the plastic clamping device module 30 with annular ring 31 and the idler bearing assembly 29 with plastic sleeve 38. Therefore, cable 14*a* rotates relative to the housing 32L and 32R**, and is thus protected from undue torsional and tensile strains which cause wear, breakage and unreliable transmission of large current in the devices described in the prior art.

It will be apparent to those skilled in the art that the embodiments of the invention shown and described are subject to modification without departing from the spirit of the invention. Thus it will be understood that the scope of the invention is not limited to the exemplary embodiments shown but rather by the claims appended hereto.

What is claimed is:

1. An apparatus for preventing the undesirable twisting of an input electrical cable section having a one conductor wire, comprising:

a housing having an input port and an output port and having an internal hollow with a plurality of component carrying compartments, with a one conductor wire directed via said input port into said housing, a conductive bearing assembly having an outer and an inner race which are operative to rotate with respect to one another about a common axis, with a central aperture associated with said inner race, said bearing assembly located in a compartment of said housing with said outer race restrained against rotation by said housing, with said one conductor wire electrically coupled to said outer race, a first clamping device module located in another compartment of said housing and operative to clamp said one conductor wire to prevent said one conductor wire from being pulled out of said input port, an output wire electrically coupled to said inner race, and directed through said output port, a second clamping device module located in a compartment of said housing and operative to clamp said output wire, an idler bearing assembly having an inner and an outer race, with said output wire directed through an aperture of said idler bearing assembly inner race prior to leaving said output port, and a bearing retainer surrounding said output wire, said bearing retainer extending from said idler bearing through said output port while having a portion contained in said housing with an opening adjacent said idler bearing assembly, whereby as said inner race of said conductive bearing assembly rotates with said idler bearing, said second clamping device module rotates with said output wire with said bearing retainer serving as a restraining guide to enable said output wire and clamping device to follow rapid rotation of said inner race of said conductive bearing assembly.

2. An apparatus for preventing the twisting of electrical cables in accordance with claim 1 wherein said bearing assemblies contain ball bearings.

3. An apparatus for preventing the twisting of electrical cables in accordance with claim 1 wherein said idler bearing assembly is contained in a plastic sleeve rotatably contained within said housing.

4. An apparatus for preventing the twisting of electrical cables in accordance with claim 1 wherein said one conductor wire is fixably mounted on said outer race of said conductive bearing assembly by soldering said one conductor wire to a "C" shaped clamp which is friction fit about the circumference of the conductive bearing outer race.

5. An apparatus for preventing the twisting of electrical cables in accordance with claim 1 wherein said output wire is affixed to said bearing inner races by soldering.

6. An apparatus for preventing the twisting of electrical cables in accordance with claim 1 further comprising an electrically conductive inner sleeve that is press fit into said central aperture of said conductive bearing inner race, thus being electrically coupled with said output wire.

7. An apparatus for preventing the twisting of electrical cables in accordance with claim 1 wherein said first and second clamping device modules are plastic clamping device modules of the type used to secure appliance cords.

8. An apparatus for preventing the twisting of electrical cables in accordance with claim 1 wherein the conductive bearing outer race is retained in said housing by a machined recesses.

9. An apparatus for preventing the twisting of electrical cables in accordance with claim 1 wherein said housing is a multipart housing that is secured together by a sliding plastic tube.

10. An apparatus for preventing the twisting of electrical cables in accordance with claim 1 wherein said housing consists of first and second sections, the inner surface of which has a plurality of precisely located recesses forming compartments which locate and retain said first and second clamping devices and the conductive and idler bearing assemblies, the one conductor and output wires directed to the outer races of the bearing assemblies.

11. An apparatus for preventing the twisting of electrical cables for use in connecting a first cable having first and second wires at one end and an electrical connector at the other end to a second cable having first and second wires at one end and an electrical connector at the other end to enable rotation between said cables relatively free from undue tensile and torsional forces on said wires, comprising:

first and second conductive bearing assemblies each having an inner and outer race, means for connecting the first wire of said first cable to the outer race of said first conductive bearing assembly and means for connecting the second wire of said first cable to the outer race of said second conductive bearing assembly, means for connecting the first wire of said second cable to the inner race of said first conductive bearing assembly and means for connecting the second wire of said second cable to the inner race of said second conductive bearing assembly, a first clamping means surrounding said first cable at said end near said first and second wires, a second clamping means surrounding said second cable at said end near said first and second wires, a rotatable idler bearing assembly having an inner and outer race with said inner race having an aperture for surrounding said second cable and said bearing assembly located between said second clamping means and said other end, a bearing retainer surrounding a portion of said second cable to maintain said surrounded portion of said second cable relatively rigid, a housing having a plurality of compartments with a first and second compartment holding said first and second bearing assemblies with said outer races rigidly fixed with respect to said housing to enable said inner races to rotate, with said first cable directed from one end of said housing and with said first clamping means positioned within a housing compartment, with another compartment holding said second clamping means, said idler bearing assembly and a portion of said bearing retainer which abuts against said idler bearing assembly and extends through said housing, whereby said second cable, said second clamping means and said idler bearing assembly can rotate with respect to said first cable with said first and second clamping means preventing said cables from being pulled from said housing with said idler bearing assembly and said bearing retainer allowing said second cable and said second clamping means to follow the rotation of said inner races of said first and second conductive bearing assemblies.

12. An apparatus for preventing the twisting of electrical cables suitable for use to connect a first cable section having a first and a second wire to a second cable section having a first and second wire to enable a rotatable connection free from undue tensile and torsional forces on the said wires and movable parts of said apparatus, which comprises:

(a) a transparent plastic segmented housing which segments are lockable together by a sliding transparent plastic sleeve;

(b) a plurality of precisely positioned recesses within said housing to form compartments to contain various components of the apparatus;

(c) a first rotatable ball bearing assembly comprised of a first inner race and a first outer race;

(d) a second rotatable ball bearing assembly comprised of a second inner race and a second outer race;

(e) a first plastic clamping device module through which is directed said first cable section and a second plastic clamping device module through which is directed said second cable section;

(f) a first and a second annular ring used to tighten said first and said second plastic clamp device modules;

(g) means for attaching the first wire of said first cable to the outer race of said first bearing assembly and the second wire of said first cable to the outer race of said second bearing assembly;

(h) means for attaching the first wire of said second cable to the inner race of said first bearing assembly and the second wire of said second cable to the inner race of said second bearing assembly;

(i) an idler bearing through which said second cable is directed and which is contained in said housing;

(j) a plastic sleeve which is placed about the outer race of said idler bearing assembly and which is contained in said housing;

(k) a bearing retainer constructed of metal having a flared end through which is directed said second cable and which flared end rests against said idler bearing and which is contained in said housing;

(l) a means for positioning said first and said second bearing assembly inner races, said first and said second wires of said second cable, said idler bearing assembly, said plastic sleeve, said bearing retainer, said second cable and its associated said second plastic clamp device module with said annular ring rotatably within said housing and said sliding transparent plastic sleeve;

(m) a means for positioning said first cable and its associated said first plastic clamp device module with said annular ring, said first and said second bearing assembly outer races with associated said first and second wires fixably within said housing and said sliding transparent plastic sleeve;

(n) a first elastomeric grommet through which is directed said first cable and which fits against the end of said housing to seal out dust, dirt and debris;

(o) a second elastomeric grommet through which is routed said second cable and said bearing retainer; and (p) an elastomeric washer through which is directed said second cable and which abuts against said second elastomeric grommet.

* * * * *